US006270853B1

(12) United States Patent
Brown et al.

(10) Patent No.: US 6,270,853 B1
(45) Date of Patent: Aug. 7, 2001

(54) ELECTROSTATIC POWDER COATING OF ELECTRICALLY NON-CONDUCTING SUBSTRATES

(75) Inventors: Larry W. Brown; Srini Raghavan; Arthur McGinnis; James A. Leal, all of Tucson, AZ (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 08/879,382

(22) Filed: Jun. 20, 1997

(51) Int. Cl.[7] ..... B05D 1/06; B05D 5/12

(52) U.S. Cl. ..... 427/470; 427/475; 427/485; 427/486; 427/375; 343/872

(58) Field of Search ..... 427/470, 475, 427/483, 485, 486, 375, 386, 385.5; 343/872, 902

(56) References Cited

U.S. PATENT DOCUMENTS

| | | | | |
|---|---|---|---|---|
| 2,079,692 | | 1/1937 | Ellis et al. . | |
| 3,342,621 | * | 9/1967 | Point et al. . | |
| 3,708,321 | | 1/1973 | Spieles . | |
| 4,000,333 | | 12/1976 | Cwayna et al. . | |
| 4,091,048 | | 5/1978 | Labana et al. . | |
| 4,530,778 | | 7/1985 | Nelson et al. . | |
| 4,686,108 | | 8/1987 | Nason et al. . | |
| 5,073,579 | | 12/1991 | Macholdt et al. . | |
| 5,208,603 | * | 5/1993 | Yee | 343/909 |
| 5,219,493 | * | 6/1993 | Seshadri | 252/500 |
| 5,229,036 | | 7/1993 | Sienkowski et al. . | |
| 5,344,672 | * | 9/1994 | Smith | 427/195 |

FOREIGN PATENT DOCUMENTS

| | | |
|---|---|---|
| 1571125A | 11/1995 | (DE) . |
| 0 033 134 | 8/1981 | (EP) . |
| 0114252A | 8/1984 | (EP) . |
| 0136478A | 4/1985 | (EP) . |
| 2429620 | 1/1980 | (FR) . |
| 2713518A | 6/1995 | (FR) . |
| 1099712A | 1/1968 | (GB) . |
| 1 198 462A | 7/1970 | (GB) . |
| 9222912A | 12/1992 | (WO) . |

OTHER PUBLICATIONS

"Electrostatic Powder Coating", J.F. Hughes et al, Research Studies Press Ltd, pp. 1–12, 1984.*

T. L.Ellis, et al, "Selective Electrostatic Coating of Nonconductive Substrates", vol. 15, No. 9, Feb. 1973; pp. 2726–2727, XP002079692, New York US (See Whole Document).*

* cited by examiner

*Primary Examiner*—Frederick Parker
(74) *Attorney, Agent, or Firm*—David W. Collins; Andrew J. Rudd; Glenn H. Lenzen, Jr.

(57) ABSTRACT

A powder coating method includes applying an antistatic material to the surface of an electrically nonconducting substrate. The antistatic material is preferably a fatty amine salt and is applied by spraying. A flow of electrostatically charged powder particles is directed toward the substrate to form a powder coating on the substrate, and the powder coating is thereafter cured.

13 Claims, 2 Drawing Sheets

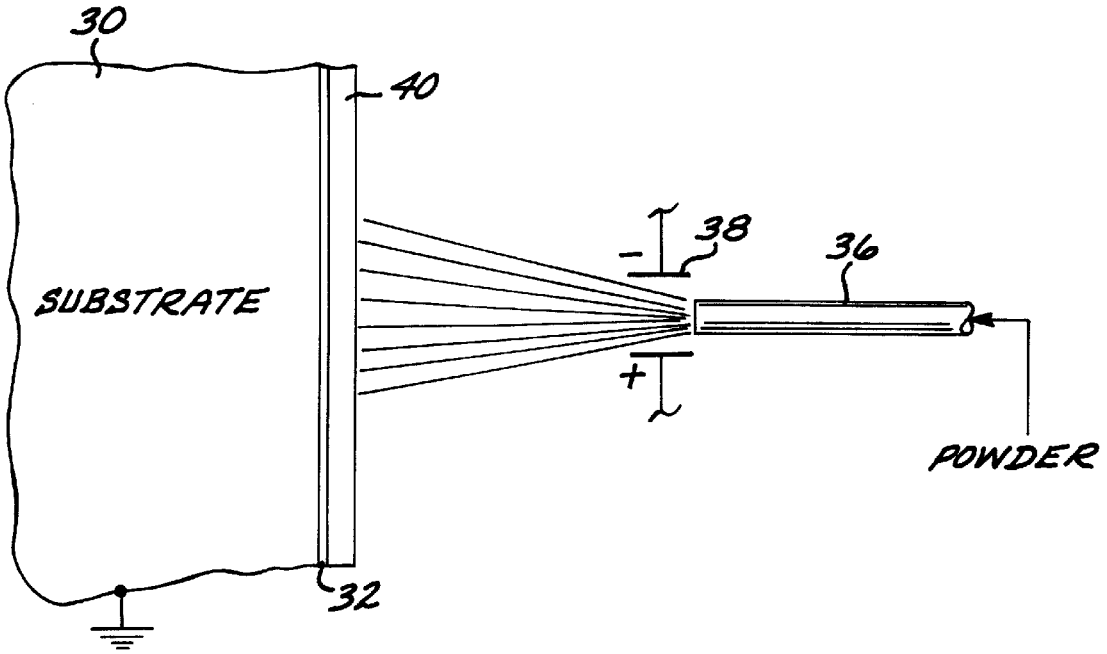
FIG. 3
FIG. 4
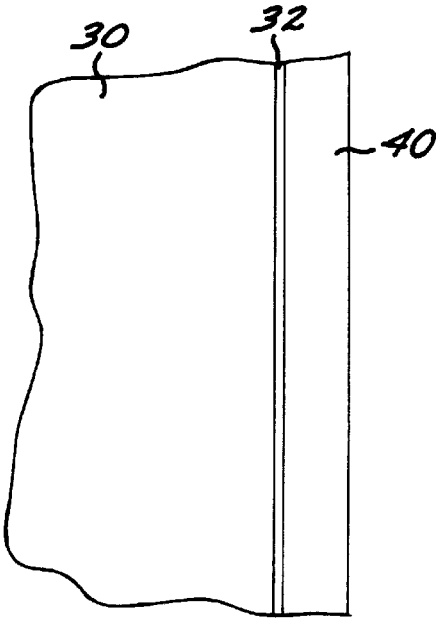

ELECTROSTATIC POWDER COATING OF ELECTRICALLY NON-CONDUCTING SUBSTRATES

BACKGROUND OF THE INVENTION

This invention relates to the powder coating of electrically nonconducting substrates.

Powder coating is a technique used to provide a durable coating on a surface. Powder particles of a curable organic powder-coating compound are electrostatically charged and directed toward the surface of a substrate. When the substrate is a grounded or connected to an oppositely charged metal, the particles are attracted to the surface and adhere to the surface temporarily. The surface is thereafter heated to elevated temperature to cure the curable organic compound to form the final coating.

Powder coating is a preferred alternative to painting or electrophoretic paint coating. In these processes, solvents are used as carriers for the paint pigments and other constituents of the paint coating. The solvents used for high-quality paint coatings include volatile organic compounds (VOCs), which are potentially atmospheric pollutants. Powder coating utilizes no solvents and no VOCs, and is therefore substantially more environmentally friendly.

Powder coating is more difficult when the substrate is an electrically nonconducting material such as a plastic or ceramic. Several techniques have been developed to impart sufficient electrical conductivity to the substrate that it can be electrostatically powder coated. A conductive material such as graphite can be added to the substrate to improve its conductivity, but this technique has the drawback that it requires modification of the character of the substrate. The substrate can be preheated so that the powder particles partially cure and stick when they initially contact the hot surface, but this approach requires that the substrate be heated to temperatures that cannot be tolerated by some types of substrates such as organic-matrix composite materials. In yet another approach, an electrically conductive primer, typically containing metallic or graphite particles, is coated onto the surface of the substrate.

Although this approach is operable, it leaves the finished part with an electrically conductive coating between the substrate and the cured powder coating. This electrically conductive coating can interfere with some uses of the finished part, which otherwise would not exhibit electrical conductivity.

There is a need for an improved approach for electrostatic powder coating of electrically nonconducting objects. Such an approach would find widespread application in the coating of composite materials, ceramics, plastics, and the like. The present invention fulfills this need, and further provides related advantages.

SUMMARY OF THE INVENTION

The present invention provides a method for powder coating of an electrically nonconductive substrate. The method is practiced without heating the substrate during the coating operation. There is no limitation as to the type of powder coating utilized or the apparatus and method for electrostatically charging and depositing the powder onto the substrate. The coated substrate remains electrically nonconducting with a high surface electrical resistance, an important consideration for some applications such as missile parts that must remain transparent to radio frequency signals.

In accordance with the invention, a powder coating method comprises the steps of providing an electrically nonconducting substrate, applying an antistatic material to the surface of the substrate, directing a flow of electrostatically charged powder particles toward the substrate to form a powder coating on the substrate, and curing the powder coating.

The substrate can be any electrically nonconducting material, such as, for example, a plastic, a ceramic, a glass, or a nonmetallic composite material. The antistatic material is preferably a fatty amine salt. A preferred fatty amine salt is ditallow dialkyl ammonium salt, and a most preferred fatty amine salt is ditallow dimethyl ammonium salt. The antistatic material may be applied by any known technique, such as spraying, dipping, and brushing, but spraying is preferred.

To apply the powder particles, a flow of the powder material (also sometimes termed a "powder precursor" material) is formed and electrostatically charged. Application and electrostatic charging can be accomplished by any known technique, such as passing the flow of powder particles through a charged field or inducing a charge on the particles by frictionally contacting the flow of particles with a surface. There is no known limitation on the type of powder particles that can be used. After the powder particles are applied to the substrate surface, the powder is cured by heating the powder coating and the substrate to an elevated temperature according to a curing schedule recommended for the powder coating that is used. This curing step is accompanied by an increase in the resistivity of the underlying antistatic coating, a desirable result inasmuch as the entire coated article becomes once again electrically nonconducting.

A key feature of the present approach is the application of an antistatic material to the substrate prior to powder coating. The antistatic coating, which is typically on the order of a few micrometers thick or less, provides sufficient electrical conductivity to the surface to permit the electrostatic powder coating. The surface conductivity of the antistatic-coated substrate is about $10^{12}$ ohms per square or more, and may be adjusted by heat treatments. This high resistivity does not result in unacceptable electromagnetic wave attenuation for most applications.

Other features and advantages of the present invention will be apparent from the following more detailed description of the preferred embodiment, taken in conjunction with the accompanying drawings, which illustrate, by way of example, the principles of the invention.

BRIEF DESCRIPTION OF THE DRAWINGS

FIG. 3 is a schematic elevational view of electrostatic powder coating of the substrate; and FIG. 4 is a schematic elevational view of a coated substrate.

DETAILED DESCRIPTION OF THE INVENTION

Figure 1:
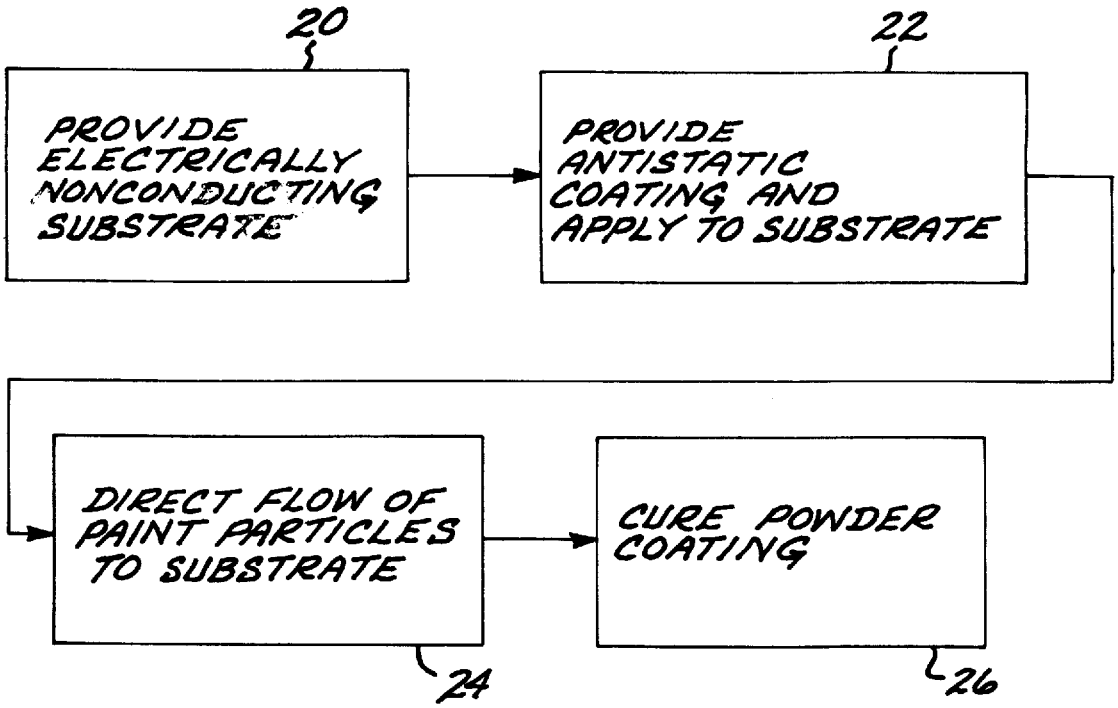
FIG. 1 is a block flow diagram of a method for powder coating according to the invention.
Figure 2:
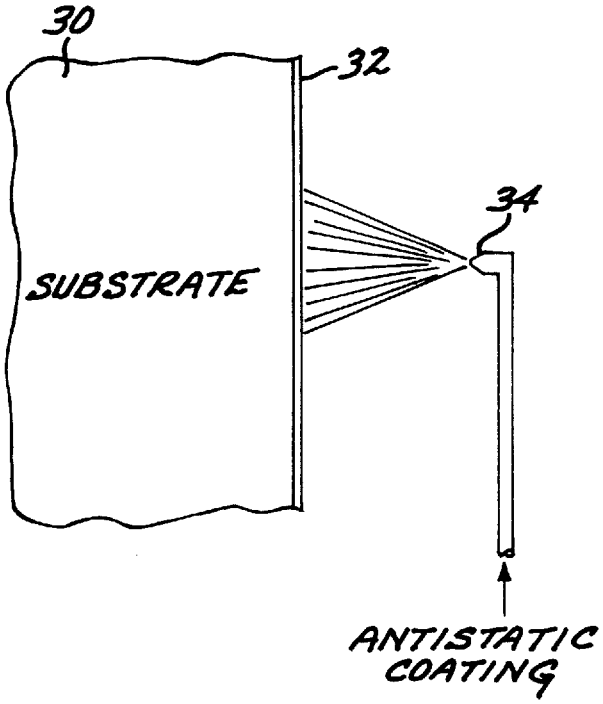
FIG. 2 is a schematic elevational view of the application of an antistatic coating to the substrate.

FIG. 1 depicts an approach for powder coating a substrate, and FIGS. 2–4 illustrate the events of the steps of the method and the final product. An electrically nonconducting substrate 30 is provided, numeral 20. The substrate can be any electrically nonconducting solid, and no limitation on its composition and form is known. Such electrically nonconducting solids can include, for example, a plastic, a ceramic, a glass, or a nonmetallic composite material. The inventors have used the process of the invention to powder coat a variety of electrically nonconducting substrates including quartz fiber/polycyanate matrix composite material, graphite fiber/polyimide matrix composite material, epoxy, a wrinkled low density polyethylene bag, polyimides, polyamnides, polyetherimide thermoplastic, polyetheretherketone thermoplastic, polycarbonate plastic, polypropylene plastic, and glass. Electrically nonconducting substrate structures that must be transparent to radio frequency energy during service are the preferred applications, such as, for example, missile and aircraft skin structures and radomes.

An antistatic coating material is provided and applied to the substrate 30 as a coating 32, numeral 22, and see also FIG. 2. Antistatic materials are known for use in other applications and are described, for example, in U.S. Pat. No. 5,219,493, whose disclosure is incorporated by reference. A preferred antistatic material for use in the present invention is a fatty amine salt such as ditallow dialkyl ammonium salt. A most preferred fatty amine salt is ditallow dimethyl ammonium salt, whose chemical structure is represented by

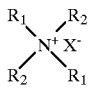

where $R_1$ is an alkyl group containing 16–18 carbon atoms COOH, $R_2$ is $CH_3$, and X– is a halide, a nitrate, or a lower alkyl sulfate ion.

The antistatic material may be applied by any operable technique, such as spraying, dipping or brushing. Spraying is preferred, as illustrated in FIG. 2. A flow of the antistatic coating (in an appropriate carrier solvent, where required) is supplied to an aerosol or other type of spray head 34, so that a thin coating 32 may be readily applied. The flow from the spray head is directed toward the substrate 30 and deposited as the coating 32. If a solvent is used, it evaporates shortly after the antistatic coating material deposits onto the surface of the substrate. The antistatic coating 32 is preferably a few micrometers thick, but this dimension is not critical.

The antistatic coating 32 dissipates the electrical charge carried to the surface of the substrate 30 during the later powder coating operation. By spreading the charge over a wide area of the substrate surface, space charge effects are reduced to an acceptably low level. The use of an antistatic coating has important advantages over use of an electrically conductive primer because it leaves no conductive particles on the surface of the substrate 30, and because it can be heat treated to a desired electrical resistivity. Consequently, the surface conductivity of the final powder-coated article remains quite low, an important consideration for substrates that are to be exposed to radio frequency energy during service.

A flow of electrostatically charged powder particles is directed to the substrate, numeral 24. The powder coating material used in the step 24 can be any operable curable powder coating material. Many such materials are known in the art, and there is no known limitation on the types of powder coatings that can be used in the present invention. Powder coating compositions are described, for example, in U.S. Pat. Nos. 3,708,321; 4,000,333; 4,091,048; and 5,344,672, whose disclosures are incorporated by reference. In the present case, the preferred powder coating composition is an epoxy, but other powder formulations such as acrylics and polyesters are also operable.

A flow of the powder coating particles is propelled from a tube 36, typically by entrainment in a flow of a gas such as air or nitrogen, toward the substrate 30 that has already been coated with the antistatic coating 32.

The powder coating particles are electrostatically charged by any operable technique. In one approach, illustrated in FIG. 3, the particles are electrostatically charged by passing through a discharge created between two electrodes 38. In another approach, friction inside the spray apparatus creates sufficient electrostatic charge on the powder particles. The thickness of the as-sprayed powder coating is typically sufficient to produce a final coating, after curing and. associated consolidation, of from about 0.001 to about 0.005 inches, most preferably from about 0.001 to about 0.003 inches, but the thickness can be larger or smaller as required.

The powder particles are typically of an organic composition that adheres to the surface of the substrate 30/antistatic coating 32 by a combination of physical adhesion and electrostatic charge attraction. Without further treatment, the powder particles can be easily removed from the surface.

To achieve a permanent, strongly adhesive powder coating 40 on the substrate 30 with the thin antistatic coating 32 interposed between, as shown in FIG. 4, the as-sprayed powder coating is cured, numeral 26. In the curing operation, the substrate 30 and uncured coatings 32 and 40 are subjected to a curing cycle specific to the particular powder coating material and which is normally provided by the manufacturer of the powder coating material. The curing cycle usually involves heating the substrate 30 and the coatings 32 and 40 to an elevated temperature for a period of time to cure the coating 40. In a typical curing operation, the substrate 30 and coatings 32 and 40 are heated to a temperature of from about 250° F. to about 340° F., for a time of about 30 minutes. The polymeric components of the coating cure, as by crosslinking and possibly with some degree of flow to consolidate, homogenize, and smooth the powder coating prior to the crosslinking. After curing, the powder coating 40 is typically from about 0.001 to about 0.005 inches thick.

The heating to achieve the curing of the powder coating 40 also has the desirable effect of increasing the electrical resistivity of the antistatic coating 32. The surface electrical resistivity of the nonconductive substrate 30 and the as-applied coating 32 is typically about $10^{12}$ ohms per square. After a typical curing cycle for the powder coating 40 as discussed above, the electrical resistivity of the antistatic coating 32 typically increases to a level such that it is no longer separately measurable, and any surface resistivity measurement reflects the properties of the substrate 30 rather than the coatings 32 and 40. That is, the coating 32 is sufficiently conductive during the powder coating step 24 to permit the dissipation of charge. The conductivity of the coating 32 is thereafter reduced (i.e., resistivity increased) such that the entire coated article (substrate 30, coating 32, and coating 40) has a high electrical resistivity corresponding to that of the substrate and not the coatings.

The important consequence for applications such as the powder coating of aircraft and missile skin structures and radomes is that these substrates, after curing of the coatings, are surprisingly and unexpectedly transparent to radio frequency radiation. This transparency is important for achieving low-observables technical requirements. Such an increase in resistivity cannot be achieved if a conventional conductive coating is used in the powder coating process prior to the powder coating step. Such a conventional conductive coating deposits conductive particles on the surface of the substrate, which conductive particles remain even after the curing step is complete and result in a lower surface resistivity of the coated article. In the present approach, the resistivity of the coated material returns to that of the substrate, after curing is complete.

The present invention has been reduced to practice with a number of combinations of substrates and powder coatings. Substrates used included quartz fiber/polycyanate matrix composite material, graphite fiber/polyimide matrix composite material, epoxy, a wrinkled low density polyethylene bags polyimides, polyamides, polyetherimide thermoplastic, polyetheretherketone thermoplastic, polycarbonate plastic, polypropylene plastic, and glass. The antistatic material was the ditallow dimethyl ammonium salt described above, which is available commercially in a carrier that permits spray application, and the powder coating was epoxy powder.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A powder coating method, comprising the steps of:

providing an electrically nonconducting substrate having a surface, the substrate being transparent to radio frequency radiation;

applying an antistatic material coating to the surface of the substrate;

directing a flow of electrostatically charged powder particles toward the surface of the substrate to form a powder coating on the surface of the substrate overlying the antistatic material coating, the antistatic material coating provided to dissipate electrical charges carried to the surface of the substrate by said charged powder particles; and heating the substrate with the antistatic material coating and powder coating thereon to a temperature sufficient to cure the powder coating and increase the electrical resistivity of the antistatic material coating so that the resultant coated substrate is electrically nonconducting and transparent to radio frequency radiation.

2. The method of claim 1, wherein the step of providing an electrically nonconducting substrate includes the step of providing a substrate selected from the group consisting of a plastic, a ceramic, a glass, and a composite material.

3. The method of claim 1, wherein the step of providing an electrically nonconducting substrate includes the step of providing a substrate having a form selected from the group consisting of an aircraft skin structure, a missile skin structure, an aircraft radome, and a missile radome.

4. The method of claim 1, wherein the step of applying an antistatic material coating includes the step of applying a fatty amine salt.

5. The method of claim 1, wherein the step of applying an antistatic material includes the step of applying ditallow dialkyl ammonium salt.

6. The method of claim 1, wherein the step of applying an antistatic material coating includes the step of applying ditallow dimethyl ammonium salt.

7. The method of claim 1, wherein the step of applying an antistatic material includes the step of applying the antistatic material coating to the substrate by a method selected from the group consisting of spraying, dipping, and brushing.

8. The method of claim 1, wherein the step of directing a flow includes the steps of forming a flow of the powder particles, and electrostatically charging the flow of powder particles.

9. The method of claim 8, wherein the step of electrostatically charging includes the step of passing the flow of powder particles through a charged field.

10. The method of claim 8, wherein the step of electrostatically charging includes the step of inducing a charge on the powder particles by frictionally contacting the flow of powder particles with a surface.

11. The method of claim 1, wherein the step of directing a flow includes the step of providing powder particles selected from the group consisting of an epoxy, an acrylic, and a polyester.

12. A powder coating method, comprising the steps of:

providing an electrically nonconducting substrate having a surface, the substrate being transparent to radio frequency radiation;

spraying a fatty amine salt onto the surface of the substrate to form an antistatic material coating;

directing a flow of electrostatically charged powder particles toward the surface of the substrate to form a powder coating on the surface substrate overlying the antistatic material coating, the antistatic material provided to dissipate electrical charges carried to the surface of a substrate by said charged powder particles; and heating the substrate with the antistatic material coating and powder coating thereon to a temperature sufficient to cure the powder coating and increase the electrical resistivity of the antistatic material coating so that the resultant coated substrate is electrically nonconducting and transparent to radio frequency radiation.

13. The method of claim 12, wherein the step of providing an electrically nonconducting substrate includes the step of providing a substrate having a form selected from the group consisting of an aircraft skin structure, a missile skin structure, an aircraft radome, and a missile radome.

* * * * *